US006675882B1

(12) United States Patent
Luberda

(10) Patent No.: US 6,675,882 B1
(45) Date of Patent: Jan. 13, 2004

(54) APPARATUS AND METHOD FOR MANUFACTURING ONE PIECE FLAT SIDES EXTRUDED PRODUCT

(76) Inventor: John A. Luberda, 4765 Kochville Rd., Sagniaw, MI (US) 48604

( * ) Notice: Subject to any disclaimer, the term of this patent is extended or adjusted under 35 U.S.C. 154(b) by 0 days.

(21) Appl. No.: 10/089,630

(22) PCT Filed: May 2, 2000

(86) PCT No.: PCT/US00/11785

§ 371 (c)(1),
(2), (4) Date: Mar. 29, 2002

(87) PCT Pub. No.: WO01/25712

PCT Pub. Date: Apr. 12, 2001

Related U.S. Application Data

(60) Provisional application No. 60/157,561, filed on Oct. 4, 1999.

(51) Int. Cl.[7] ..... F28F 9/02; F28F 21/08

(52) U.S. Cl. ..... 165/173; 29/890.052

(58) Field of Search ..... 428/586, 596, 428/599; 165/173, 174, 175, 176; 29/890.052, 890.054

(56) References Cited

U.S. PATENT DOCUMENTS 4,002,195 A * 1/1977 Nagase ..... 160/379
4,078,708 A * 3/1978 Mayer ..... 224/509
4,113,177 A * 9/1978 Collins et al. ..... 238/72
4,155,540 A * 5/1979 Horgan, Jr. ..... 256/23
4,505,728 A * 3/1985 Cheng et al. ..... 62/542
5,246,066 A * 9/1993 Morgan et al. ..... 165/173
5,622,220 A * 4/1997 Park et al. ..... 165/153

FOREIGN PATENT DOCUMENTS

GB 2049149 * 12/1980

* cited by examiner

*Primary Examiner*—John J. Zimmerman

(57) ABSTRACT

A one-piece extrusion (50) having a flat bottom portion (54) and supporting flat sides (74) is described. The one-piece extrusion (50) is particularly appropriate for use as a header for a heat exchanger in a cogeneration facility or other high pressure vessels. The header (50) is extruded out of steel, stainless steel, or a steel alloy. The flat bottom portion (54) of the header (50) provides a flat surface for drilling apertures (80) and connecting tubes (56) to the header (50), eliminating the need for complicated manufacturing and attachment procedures encountered with the cylindrical headers currently used. The flat bottom portion (54) also provides more surface area for attachment of the tubes (56). The flat sides (74) of the extrusion impart structural support and integrity to the header (50) and allow a greater number of headers to be placed closer together without taking up the space required for typical cylindrical headers.

12 Claims, 4 Drawing Sheets

APPARATUS AND METHOD FOR MANUFACTURING ONE PIECE FLAT SIDES EXTRUDED PRODUCT

This application claims benefit of the filing date of U.S. Provisional Application Ser. No. 60/157,561 filed Oct. 4, 1999, the entire contents of which are hereby incorporated by reference.

FIELD OF THE INVENTION

The present invention generally relates to a one-piece flat-sided extrusion for use in multiple applications, such as heat exchanger headers or other high pressure vessels, and methods of making the same.

BACKGROUND OF THE INVENTION

Extruded products are used in a variety of applications. A primary use of extruded products is to provide structural strength or stiffness to various structural shapes, such as beams, angles, channels, and tubing. In manufacturing steel extruded products or extruded products made out of heavy material, the material is heated and pressure is applied to force the material through a diehead. As the flow of material is forced through the diehead, the material tends to conform to the shape of the cutout or opening in the die, producing an extruded product with a cross-section that matches the shape of the opening in the die. As the extrudate exits the diehead, it is cooled (usually with water) to harden the extrudate into the shaped article intended from the process.

When an extruded product is being produced for use in a high pressure environment, strong materials, such as steel or a form of steel having additives intended to strengthen or provide other enhanced structural or physical properties, need to be used. For example, cogeneration facilities employing heat exchangers commonly have cylindrical header pipes made of steel. They are manufactured with round, heavy-walled steel tubing and must comply with American Society for Testing and Materials (ASTM) standards for high pressure vessels.

Heat exchangers in general are used in a variety of applications to heat or cool gases or liquids. Heat exchangers typically include two parallel header units with a plurality of tubes connected between the two headers. Such flow designs are referred to as parallel-flow, because the tubes are parallel to each other, but the process is in actuality more of a "cross-flow" pattern. Liquids or gases flow through the tubes (side-to-side or up and down), from one header to the other, and forced outside air runs perpendicular to the tubes, i.e., crossed with the liquid or gaseous flow. The headers act to collect the cooling or heating medium being used in the application and direct the medium through the tubes.

A variety of different header shapes have been used for different applications. For applications involving high pressure within a heat exchanger, such as in cogeneration facilities, the headers are typically extruded into a cylindrical shape. Cogeneration heat exchanger headers have also been formed having a rectangular shape, but these headers have joints where individual portions of the header are attached or welded together. Rectangular headers have also been criticized as not being as good pressure vessels as are cylinders.

FIG. 1 shows one cylindrical header pipe 10 of the type currently in use. Header 10 has tube receiving apertures 12 drilled at various angles to surface 14. Tubes 16 are inserted into apertures 12.

Cylindrical header pipes 10 with this structure present some problems due to their shape. The fabrication process is costly and difficult due to the odd angles at which apertures 12 need to be machined in the continuous curving surface 14 of the header 10 to allow for the incorporation of tubes 16 into the header 10. The apertures 12 are drilled on a contoured surface 14, commonly called hillside boring. In manufacturing apertures 12, deformation may occur around the edges of the apertures 12. Furthermore, structural integrity is jeopardized by the removal of material in a concentrated area 17, resulting in deformation caused by lack of structural support. The contact thickness of the area 17 where the header 10 and the tubes 16 are to be connected becomes less than the thickness of the remainder of the header 10 since the aperture 12 is formed on a curved surface 14 rather than a flat plane. As a result, the aperture 12 is angled. Accordingly, the coupling of the end of the tube 16 to the tube receiving aperture 12 of the header 10 becomes unstable.

For example, the welding process to attach tubes 16 is extremely difficult because of the contoured areas encountered with a curved connection surface 14. Thus, the junction between the header 10 and the tube 16 is rendered incomplete, causing leakage of the heat exchange medium.

Additionally, an unnecessary space 18 is formed around the tube 16 when it is inserted into the area 17 inside of the header 10 so that the flow efficiency of the heat exchange medium is lowered, and the necessary amount of charge of the heat exchange medium is increased. It is also difficult to adjust the depth to which the tube 16 is inserted into the header 10 during manufacturing.

Moreover, when tube receiving apertures 12 are manufactured in cylindrical headers 10, a second stage of machining is required to machine chamfers 13 around each aperture 12 drilled for the tubes 16 to accommodate the welding process. This second stage of machining is time consuming and adds additional cost to the production of the header 10.

An additional header is discussed in U.S. Pat. No. 5,246,066, which discloses an extruded tank that has four solid longitudinal side walls. Three of the walls are generally flat-sided and a fourth side, into which flat sided extruded tubes are inserted, is formed as an arc or a curvature bowing outwardly from the fluid-containing space. This curved shape also presents the above-discussed problems.

A one-piece header with a flat side is disclosed in U.S. Pat. No. 5,842,515. However, this header is not extruded to form one continuous piece, but is formed by bending a malleable aluminum sheet with both sides of the sheet coming into contact with each other to form a hollow passage inside the header, and then brazing the sides of the sheet together to seal the opening. This type of header would not be appropriate for use in a high pressure environment, as the thickness of steel required when using high pressures would not allow the manufacture of the header through bending.

An extruded aluminum header pipe with a flat side is disclosed in U.S. Pat. No. 5,622,220. Similar to other aluminum headers, this header would not be suitable for use in a high pressure environment. The header pipe has a D-shaped cross-section with a flat side and is manufactured by extrusion. This header, however, is manufactured for use in an automobile air conditioning system and accordingly, is made out of aluminum. Additionally, this header has a flat section with a rounded section extending from opposed sides of the flat section. A header for use in a cogeneration facility or other high pressure vessel needs side walls that are substantially perpendicular to the flat section and that provide more structural support and integrity than the minimal support provided by the rounded section defining the D-shaped header in U.S. Pat. No. 5,622,220.

Furthermore, there are distinct differences in the manufacturing requirements, and thus the components used, in an air-conditioning heat exchanger unit as opposed to a cogeneration facility heat exchanger unit. For example, the size of a cogeneration facility heat exchanger unit is several hundred times larger than an automobile (or other similar-type use) heat exchanger unit. Because of this, the construction materials used in a cogeneration facility heat exchanger are entirely different. The extreme pressures and temperatures reached during normal operation of a cogeneration facility would render the processes and materials used to manufacture an automobile (or other similar-type use) heat exchanger unit inadequate for use in cogeneration facilities. For example, the stresses accruing during operation of a cogeneration facility are greatly increased. Accordingly, the construction materials for a heat exchanger unit for use with a cogeneration facility must be able to withstand extreme pressures, for example, those up to 3600 psig. The thickness of the material used in a cogeneration facility heat exchanger is also increased from that of an automobile air conditioning (or other similar-type) heat exchanger due to the pressures involved.

Moreover, different manufacturing methods and material specifications are required for cogeneration facility heat exchanger units as opposed to automobile (or other similar-type use) heat exchanger units. For example, the criteria for attaching tubes to a header for use in a cogeneration facility must meet standards for high pressure vessels set forth by the ASTM for construction of heat recovery steam generators (HRSG's).

It is also not possible to form tube receiving apertures in the thick steel by pressing, which is the method used in U.S. Pat. No. 5,622,220. In forming a heat exchanger for use in a cogeneration facility, apertures must be drilled in a header and tubes are secured by being welded into the apertures.

U.S. Pat. No. 5,622,220 also requires brazing metal plates made out of thin aluminum to facilitate the connection of the tubes to the header pipes. The patent does not disclose a heat exchanger for use in a cogeneration facility, nor does it disclose a steel header or steel extruded product, or any way of forming a header suitable for use in a cogeneration facility.

Thus, it is desirable to form a steel header through one extruded piece that is suitable for use in a cogeneration facility and that has a flat bottom portion wherein tubes can be easily attached and flat sides to provide support and structural integrity.

SUMMARY OF THE INVENTION

The present invention provides a one-piece extrusion having a flat bottom portion and supporting flat sides. The one-piece extrusion is particularly appropriate for use as a heat exchanger header on a cogeneration facility. This invention reduces the number of components forming the header to one continuous piece that is manufactured out of steel or a steel alloy. This invention provides a header that eliminates the need for the complicated manufacturing and welding procedures encountered with the cylindrical headers currently being used. It eliminates the need to drill tube receiving apertures on a contoured surface and provides a way to manufacture the apertures and form the chamfers on the edges of the apertures substantially simultaneously. This invention also provides a seamless header having a flat bottom portion and supporting flat sides that is not formed by bending or creating seams, but is instead one continuous header without joints or seams.

The flat bottom portion of the header of the present invention facilitates the attachment of tubes to the header by permitting the openings for the tubes to be machined more easily. The machining and welding can be done on a flat surface, which eliminates the need for specially angled entry points for the attachment of tubes or for welding on an angle, which often causes leaks. This is of particular concern when manufacturing a heat exchanger header for use in a cogeneration facility, as opposed to a header used in an automobile air conditioning heat exchanger unit or other uses that are not subject to a high pressure and temperature atmosphere. Steel cogeneration facility headers are required to be pressure-certified according to ASTM standards, providing additional difficulty and obstacles when manufacturing headers for such uses.

The strong steel header of the present invention allows the tubes to enter the flat bottom portion of the header at a substantially perpendicular angle to the flat bottom portion, providing an easier, stronger and faster overall weld due to the ease of access all around the entry points of the tubes into the header.

This substantially perpendicular entrance of the tubes decreases the number of potential leaking joints. It also causes less material to be lost in the machining process. The material typically lost in the machining process of cylindrical headers is shown in FIG. 1, where the thickness of header 10 at area 17 is less than the thickness of the remainder of the header 10. The flat bottom portion of the present invention allows for a more conventional drilling method, which strengthens the structural integrity of header by causing less material to be lost, and is less time consuming and less costly.

The present invention also provides more surface area than the cylindrical headers presently used because it has a flat bottom portion, allowing more tubes to be attached to the header because tubes can be placed right up to the edge of the flat bottom portion if desired or necessary. The invention also allows the tubes to be attached more efficiently by providing a flat surface for drilling and welding the tubes to the header. Furthermore, the flat bottom portion of this invention also allows a chamfering tool to be mounted to the external portion of the drill or boring tool in order to chamfer the edges of the apertures while the apertures are being formed, rather than requiring the separate chamfering step that is used to manufacture cylindrical headers.

The present invention also provides a header having two flat sides formed integrally with and adjoining the flat bottom portion of the header. The flat sides help provide the structural support and integrity necessary to stabilize and strengthen a header for use in a cogeneration facility heat exchanger. The flat sides also allow a greater number of headers to be placed closer together, without taking up the space required for cylindrical headers.

Other features and advantages of the present invention will become apparent from the following detailed description in conjunction with the accompanying drawings, which illustrate, by way of example only, the features of the present invention and are not intended to limit the invention in any way.

BRIEF DESCRIPTION OF THE DRAWINGS

These and other features of the invention will appear from the following written description, and from the drawings, in which.

DETAILED DESCRIPTION

Figure 2:
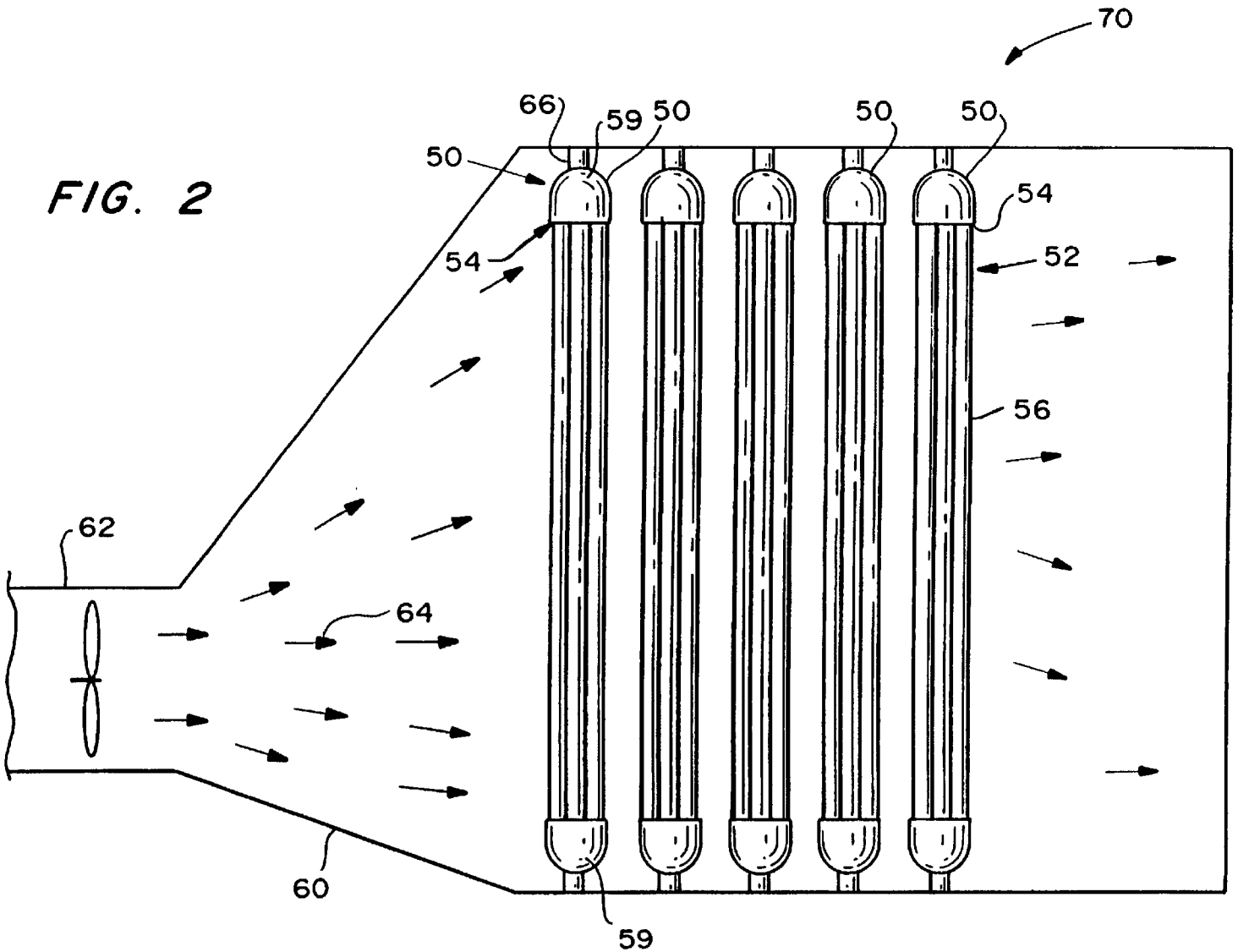
FIG. 2 is a view of a cogeneration facility employing a plurality of heat exchangers with one-piece headers with flat bottom portions made according to the present invention.

The invention generally relates to a one-piece extrusion having a flat bottom portion and flat sides. The extrusion of this invention is particularly appropriate for use as a heat exchanger header in a cogeneration facility. The header may be used in various temperature applications, such as heating or cooling gases or liquids. FIG. 2 illustrates five heat exchanger units 52 in the environment of a cogeneration facility 70. Although five units 52 are shown, it is understood that greater or fewer units 52 may be used. The heat exchanger units 52 have one-piece headers 50 with flat bottom portions 54 made according to the present invention.

Figure 3:
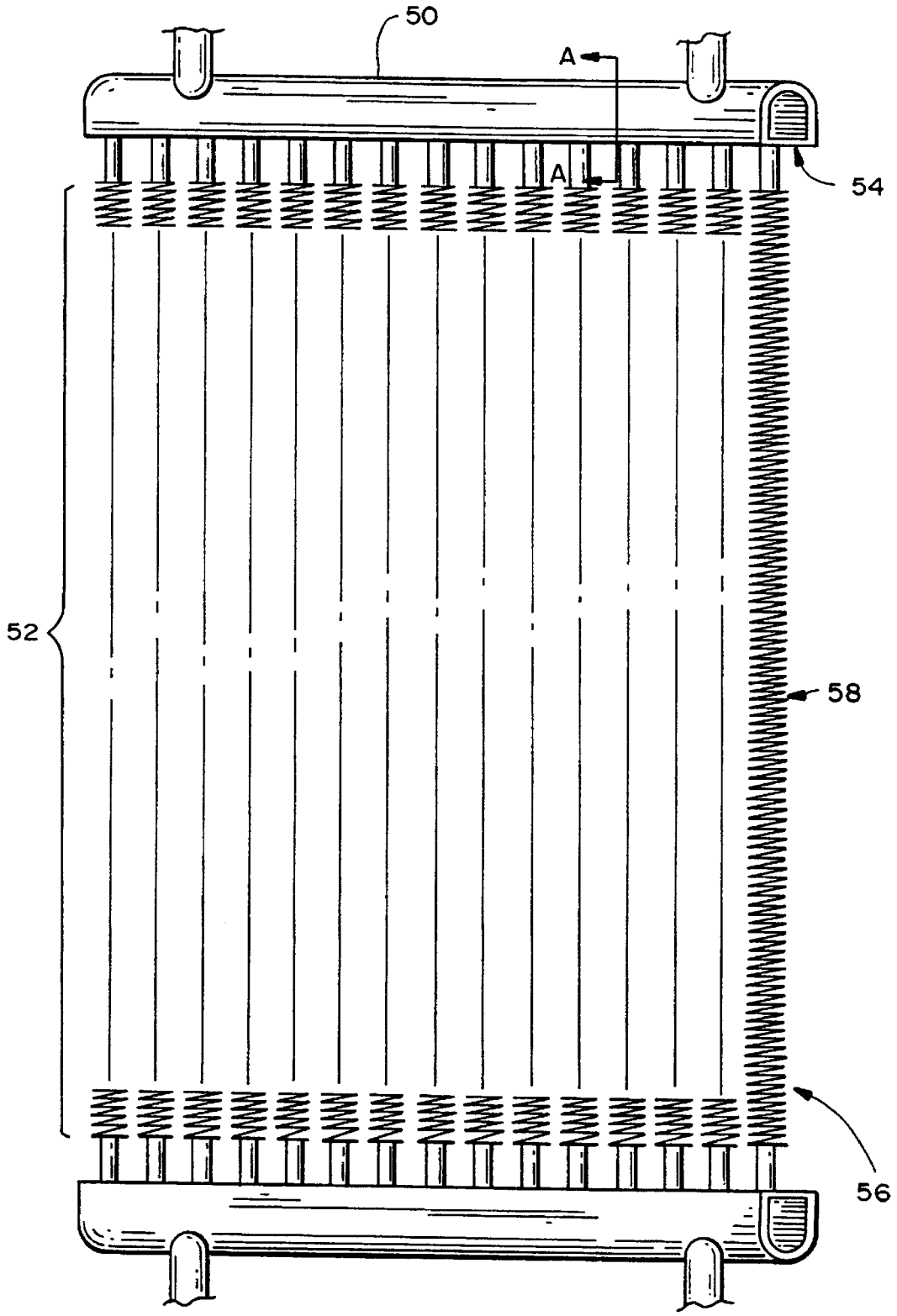
FIG. 3 is a front view of a heat exchanger unit of the present invention.

The cogeneration facility 70 of FIG. 2 has an exchanger housing 60 and a turbine 62 to move gasses or liquid through the plant 70. An air flow 64 flows through the exchanger housing 60 and is pushed by the turbine 62. Air flow 64 passes over the tubes 56 and the fins (not shown in this figure) which are arranged between the tubes 56. The purpose of fins 58, which are shown in FIG. 3, is to collect the heat from the air flow 64. Fins 58 provide a larger surface area for collecting heat.

The tubes 56 are disposed between the one-piece headers 50 and are in fluid communication therewith. There may be a single row or multiple rows of tubes 56. The tubes 56 contact and penetrate the headers 50. A heat exchange medium, such as a gas or a fluid, flows through the one-piece headers 50 and the tubes 56 for distribution throughout the heat exchanger units 52. In typical cogeneration facility applications, natural gas or another energy source is used to fire turbine 62 to generate electricity. A by-product of the turbine activity is heat. This heat from turbine 62 can be reclaimed by the heat exchanger to provide steam, which can be used to turn a generator, to provide heat, or any number of reasons. Hot air flow 64 from the turbine 62 blows into the heat exchanger housing 60 that encloses heat exchanger units 52. The heat exchanger units 52 have tubes 56 that are in fluid connection with and penetrate the headers 50. A heat exchange medium, such as fluids or gasses, flows through the tubes 56 to dissipate or accumulate the heat from the exchanger housing 60. In heat recovery steam generators (HRSG's), the tubes 56 help accumulate heat from the air flow 64 to increase the temperature of the heat exchange medium and produce steam.

The one-piece headers 50 are shown having caps 59, which in use are located on each end of each header 50 and act to enclose the heat exchange medium circulated between headers 50 and tubes 56. The headers 50 are also shown mounted and supported by structural members 66 that are in turn connected to the housing 60.

Figure 1:
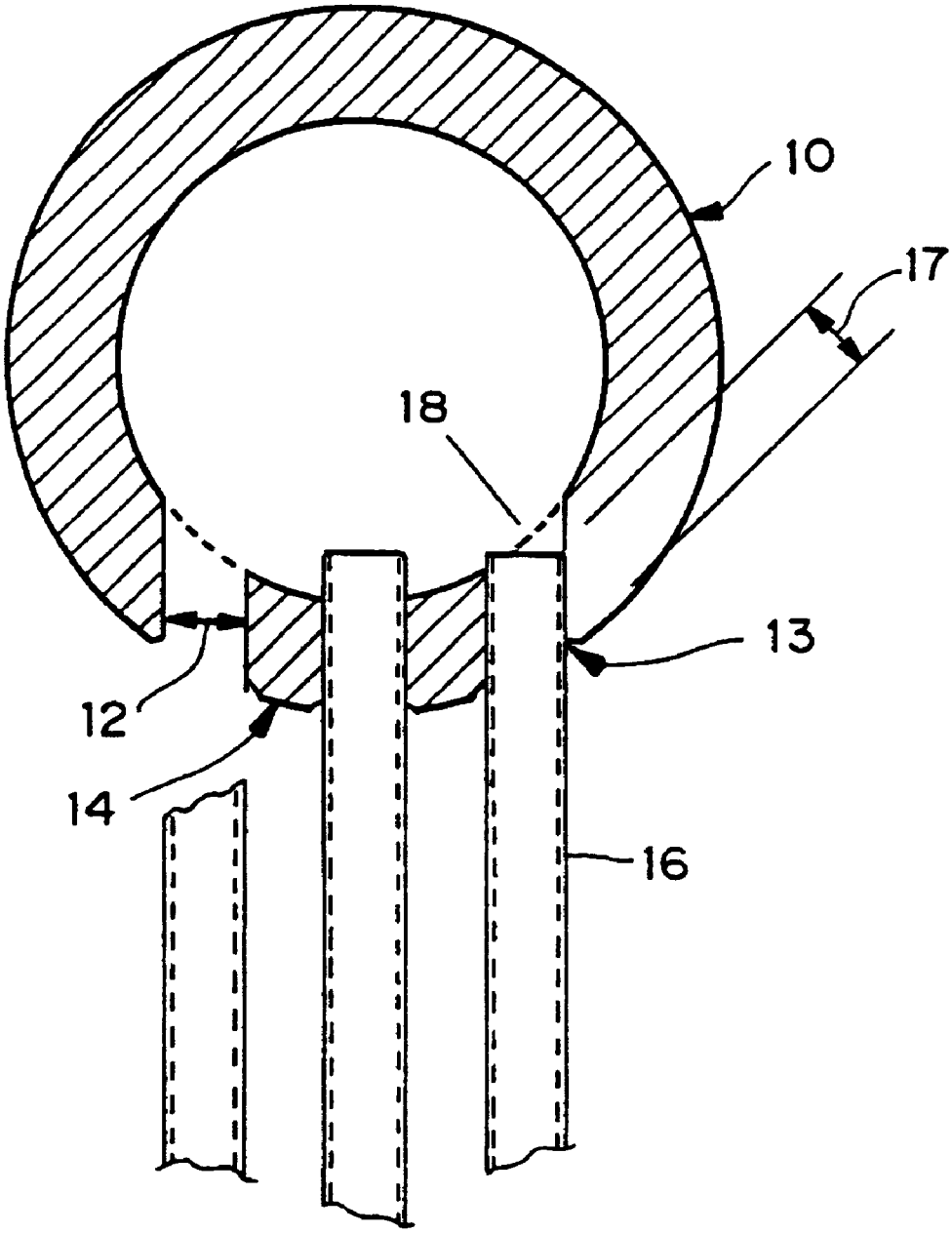
FIG. 1 PRIOR ART
FIG. 1 is an example of known cylindrical header pipes.
Figure 4:
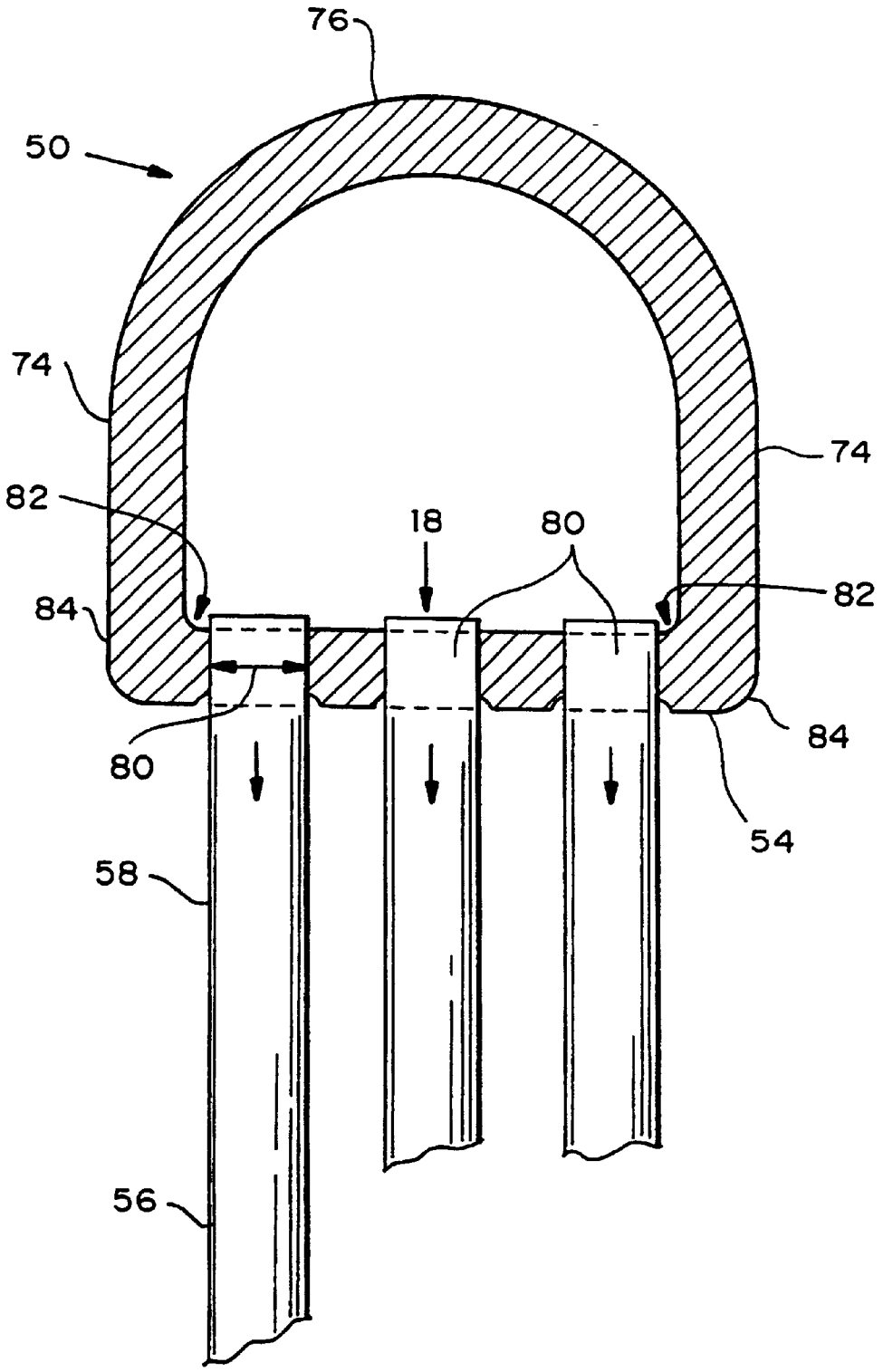
FIG. 4 is an enlarged, horizontal sectional view illustrating a one-piece header with a flat bottom portion made according to the present invention.

FIG. 3 shows a frontal view of one heat exchanger unit 52 showing cut out section AA which is further illustrated in FIG. 4. FIG. 3 illustrates the flat bottom portion 54 of one-piece header 50, as opposed to the curved portion 14 of header 10 shown in FIG. 1. Interposed between tubes 56 are fins 58, which create more surface area for collecting the heat from the air flow 64.

FIG. 4 is an enlarged, horizontal sectional view AA illustrating in more detail the one-piece header 50 with a flat bottom portion 54 made according to the present invention. FIG. 4 illustrates the seamless nature of the one-piece header 50, with substantially flat sides 74 integrally formed with flat bottom portion 54. Flat bottom portion 54 and substantially flat sides 74 seamlessly complete the one-piece header 50 at an outwardly curved upper portion 76.

The flat sides 74 help provide the structural support and integrity necessary to stabilize and strengthen a header for use in a cogeneration facility heat exchanger. They also maintain the close tolerance of the flat bottom portion 54 by supporting flat bottom portion 54 and keeping it straight against the pressures encountered. Flat sides 74 essentially act as a longitudinal support or a brace for flat bottom portion 54, thereby helping to maintain its close tolerance and flatness integrity. Flat sides 74 also facilitate the placement of a greater number of header units 50 closer together on a cogeneration facility, without taking up the space typically required for cylindrical headers. The flat sides 74 also allow more tubes 56 to be placed on header 50, because tubes 56 can be placed up to the edges of flat bottom portion 54 where it meets flat sides 74.

Header 50 also has an inner corner 82 located at the inside of header 50. Inner corner 82 is a curved portion on the inside, hollow area of header 50 where flat bottom portion 54 meets flat side 74. Inner comer 82 should be curved to prevent possible fracturing that may occur due to high pressures when header 50 is in use. If inner corner 82 is square or sharply angled, this creates a greater chance of fracturing. The outside comer 84, however, located on the outside of header 50 where the flat bottom side 54 meets the flat side 74 is also shown as curved, but this curvature is not necessary. Outside corner 84 may be any angle, such as substantially perpendicular to the flat bottom portion 54 forming a right angle, or a greater or lesser angle.

The entire one-piece header 50 is extruded from one piece of material, forming a stable one-piece header 50 that does not require braze-coupling or welding to be manufactured. Because one-piece header 50 is formed from one piece of material, it provides a one-piece header 50 with a relatively thick flat bottom portion 54. This ensures that the one-piece header 50 can withstand a high pressure environment better than a header that is formed from a malleable sheet of material. The thick flat bottom portion 54 may be the same thickness as the rest of the extruded portion or it may be a greater or lesser thickness, depending on the desired application.

One-piece header 50 also has apertures 80 drilled or machined in the flat bottom portion 54 so that header 50 is adapted to receive one or more tubes 56. Apertures 80 are drilled or bored into flat bottom portion 54 and tubes 56 are fastened therein, by any conventional or appropriate securing technique, preferably by welding. The tubes 56 are secured into apertures 80 located on the surface of flat bottom portion 54 with more ease than conventional header pipes allow, because the flat surface of bottom portion 54 alleviates the need for welding the tubes 56 at odd angles. The criteria for attachment of tubes 56 to the header 50 must meet the standard for high pressure vessels set forth by ASTM. The machining of the apertures 80 is done on a flat surface, eliminating the need for specially angled entry points typically necessary on a cylindrical header pipe. This provides a stronger and faster weld, while decreasing the potential of leaking joints. FIG. 4 also shows the flow 78 of a heat exchange medium, such as gasses or liquids, within the one-piece header 50 and through the tubes 56 where the fins 58 can dissipate or accumulate the heat.

It should also be noted that the drilling methods used to manufacture tube receiving apertures in steel headers for use in cogeneration facility heat exchangers are drastically different from the pressing methods used to manufacture tube receiving apertures in aluminum headers for use in other applications. Accordingly, different thicknesses, temperatures, and methods are required when manufacturing the header of the present invention, as is required for any cogeneration facility heat exchanger headers so that it complies with ASTM standards.

The one-piece header 50 of the present invention is constructed out of steel, stainless steel, any alloy thereof, or any other type of material that meets the certification and manufacturing specifications. The material is extruded using known techniques so that the resulting article has a flat bottom portion 54 where tube receiving apertures are to be manufactured and flat sides 74 to provide structural support and integrity. The rest of the article may be any appropriate shape, for example, a curved upper portion 76. Of importance is the flat bottom portion 54 intended to receive tubes 56 and the flat sides 74.

In a preferred embodiment, the header dimensions range from a width of about eight inches to about twelve inches and from a height of about eight inches to about twelve inches, with the thickness of the material comprising anywhere from one half inch to three inches thick. More particularly, the header may range from between about one half inch to about three fourths of an inch in one embodiment to between about one and one fourth inch to about two and one fourth inch in another embodiment. The thickness may be uniform throughout the header or may vary, depending upon the desired application. The substantially flat sides 74 should have a height of about four inches to about eight inches from the flat bottom portion to upper portion 76. The outer diameter of the extruded header comprised of steel may range anywhere from about six inches to about twelve inches, or as individual specifications or requirements provide. The invention is not limited to these dimensions, which are given by way of example only.

From the foregoing, it will be appreciated that the heat exchanger header of the present invention accomplishes a number of important objectives. It reduces the total number of components, thereby facilitating assembly while reducing cost. It also decreases the number of potential leaking joints by eliminating the need for specialized machining of the angled entry points for the attachment of tubes. It provides a one-piece extruded header having a flat bottom portion as opposed to the cylindrical headers currently in use in cogeneration facilities. Accordingly, the tubes enter the header at a substantially perpendicular angle, providing an easier, stronger and faster overall weld and causing less material to be lost in the machining process through time saving drilling methods. It also provides a structurally sound header supported by two flat sides formed integrally with and adjoining the flat bottom portion of the header. It further provides a header that can withstand high pressures due to the strength of material and the inner corner that helps decrease the fracture point in high pressures. Overall, the one-piece extruded header with a flat bottom portion of the present invention eliminates components and fixtures, facilitates assembly, avoids leaks, reduces cost, and facilitates the ease of machining and welding.

The forgoing description of the preferred embodiments of the invention has been presented only for the purpose of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Thus, while the preferred embodiments of this invention have been set forth, it will be appreciated that the details given herein may be varied by those skilled in the art without departing from the spirit and scope of the appended claims.

What is claimed is:

1. A heat exchanger header capable of withstanding pressures of up to 3600 psig, comprising:

(a) a flat bottom portion; and (b) substantially flat sides extending from the flat bottom portion, wherein the heat exchanger header is formed from an extrusion comprising steel, providing a seamless and integrally formed heat exchanger header for use in a cogeneration facility.

2. The heat exchanger header of claim 1, further comprising a curved upper portion.

3. The heat exchanger header of claim 2, further comprising a structural member attached to the curved upper portion for mounting the header to a housing of the cogeneration facility.

4. The heat exchanger header of claim 1, wherein the flat bottom portion is approximately one half inch to approximately three inches thick.

5. The heat exchanger header of claim 1, wherein the flat bottom portion is approximately one half inch to approximately two and one quarter inches thick.

6. The heat exchanger header of claim 1, further comprising two inner corners that are curved and that are located on the inside of the header where the substantially flat sides extend from the flat bottom portion.

7. A method for making a heat exchanger header capable of withstanding pressures of up to 3600 psig, comprising:

(a) extruding a product comprising steel in the shape of a header having a flat bottom portion and flat sides extending from the flat bottom portion, the product having two open ends; and (b) drilling a plurality of apertures into the flat bottom portion, the apertures being adapted to receive a plurality of tubes.

8. The method of claim 7, further comprising capping the two open ends of the steel product.

9. The method of claim 7, wherein tubes are secured in the apertures by welding.

10. A method for generating steam in a cogeneration facility capable of withstanding pressures of up to 3600 psig, comprising:

(a) providing a cogeneration facility housing to which at least one heat exchanger unit is coupled, the heat exchanger unit comprising a one-piece extruded header with a flat bottom portion, flat sides extending from the flat bottom portion, and tubes connected to the flat bottom portion and in fluid connection thereto;

(b) providing a heat exchange medium flowing through the header and the tubes; and (c) passing heat or air over the tubes.

11. The method of claim 10, wherein the one-piece extruded header is comprised of steel, stainless steel, or a steel alloy.

12. A one-piece, flat-sided heat exchanger header capable of withstanding pressures of up to 3600 psig, comprising:

(a) an extruded product comprised of steel having a flat bottom portion, the flat bottom portion having a thickness of about one half inch to about three inches and a plurality of apertures adapted to receive tubes machined therein;

(b) substantially flat sides extending from the flat bottom portion, the substantially flat sides providing structural support for the header in part by maintaining a close tolerance of the flat bottom portion;

(c) curved inside comers located where the flat bottom portion meets the substantially flat sides, the curved inside corners preventing the header from fracturing due to high pressures encountered when the header is in use;

(d) a curved upper portion opposite the flat bottom portion where the substantially flat sides seamlessly complete the one-piece flat-sided heat exchanger header.

* * * * *